US005452870A

United States Patent [19]

Heggestad

[11] Patent Number: 5,452,870

[45] Date of Patent: Sep. 26, 1995

[54] FIXED DATA TRANSMISSION SYSTEM FOR CONTROLLING TRAIN MOVEMENT

[75] Inventor: Robert E. Heggestad, Raytown, Mo.

[73] Assignee: Harmon Industries, Inc., Blue Springs, Mo.

[21] Appl. No.: 259,892

[22] Filed: Jun. 16, 1994

Related U.S. Application Data

[62] Division of Ser. No. 929,790, Aug. 13, 1992, Pat. No. 5,340,062.

[51] Int. Cl.[6] ..... B61L 3/02

[52] U.S. Cl. ..... 246/182 R; 246/187 B

[58] Field of Search ..... 246/3, 4, 5, 34 R, 246/167 R, 182 R, 187 R, 187 A, 187 B

[56] References Cited

U.S. PATENT DOCUMENTS

| | | | |
|---|---|---|---|
| 3,250,914 | 5/1966 | Reich | 246/5 |
| 3,284,627 | 11/1966 | Wilcox | 246/182 R X |
| 3,402,289 | 9/1968 | Burke et al. | 246/167 R |
| 3,794,833 | 2/1974 | Blazek et al. | 246/187 B X |
| 3,967,801 | 7/1976 | Baughman | 246/182 R X |
| 4,046,342 | 9/1977 | Buzzard | 246/187 B X |
| 4,279,395 | 7/1981 | Boggio et al. | 246/182 R |
| 4,655,421 | 4/1987 | Jaeger | 246/167 R |
| 4,711,418 | 12/1987 | Aver, Jr. et al. | 246/5 |
| 4,768,740 | 9/1988 | Corrie | 246/187 B X |
| 5,072,900 | 12/1991 | Malon | 246/5 |
| 5,332,180 | 7/1994 | Peterson et al. | 246/3 |
| 5,364,047 | 11/1994 | Petit et al. | 246/182 R X |

*Primary Examiner*—Michael S. Huppert
*Assistant Examiner*—Scott L. Lowe
*Attorney, Agent, or Firm*—Chase & Yakimo

[57] ABSTRACT

A train control-system employs beacon transponders along the track to transmit fixed data to a passing train in addition to dynamic data relating to track availability and routing provided by encoded cab signals transmitted in the track. The fixed data includes the location of block boundaries and distances to such boundaries, timetable speed limits, and the distance to a point along the track at which a speed restriction is in effect. This data and other fixed information is integrated with the dynamic data in an on-board computer which determines train control instructions from the received data and displays the instructions to the train crew. The system is capable of enforcing any restrictive instructions that are not obeyed.

8 Claims, 11 Drawing Sheets

BLOCK BOUNDARY TRANSPONDERS

SPEED LIMIT TRANSPONDERS

FIXED DATA TRANSMISSION SYSTEM FOR CONTROLLING TRAIN MOVEMENT

This application is a division of application Ser. No. 929,790, filed Aug. 13, 1992, U.S. Pat. No. 5,340,062, issued Aug. 23, 1994.

BACKGROUND OF THE INVENTION

This invention relates to improvements in systems for controlling the movement of a train along a railroad track and, more particularly, to a train control system which integrates dynamic and fixed data concerning the stretch of track over which the train is travelling and conditions existing on the track ahead, and which determines train control instructions from such data and has the capability of enforcing any restrictive instructions that are not obeyed.

Railroad signalling and train control systems have traditionally been based on the concept of protecting zones of track, called "blocks," by means of some form of signal system that conveys information to the locomotive engineer about the status of one or more blocks in advance of the train. Wayside signal lights located along the track are controlled by electrical logic circuits which use track circuits to detect the presence of a train in any given block, and automatically combine the status of several adjacent blocks to present the proper aspect, or combination of lights, to indicate to the train crew whether the train may proceed at maximum speed, should reduce speed due to more restrictive conditions ahead, or should be brought to a stop. The distance required to slow or stop a moving train is sufficiently long that information must be conveyed to the train at least one full block in advance of where the reduced speed or stop is required.

An alternative approach which is used on portions of some railroad systems is referred to as cab signalling and may be used with or without wayside signal lights. In cab signalling the same logic that determines block status for display on the wayside signals is also used to generate one of several forms of encoded electrical current in the rails, such that block status is represented by the selection of the code rate used. Equipment on the locomotive detects the coded currents through inductive pickup coils located just above the rail and ahead of the lead wheels, and decodes the information to arrive at a status to be displayed in the engine cab in the form of a pattern of lights similar to those used on wayside signals. The particular pattern of lights displayed is called the "aspect" of the signal. Displaying this information in this manner makes the block status visible to the train crew continuously, not just while approaching a wayside signal, and also permits any change in block status to be displayed immediately as it happens rather than at the next wayside signal which may be far ahead and out of sight at the time of the change in status.

Most cab signal systems include some form of automatic train control (ATC) feature which uses one or more methods to assure that the train crew is alert and responding to any changes in cab signal aspects. Some of these systems only require acknowledgement of the change, while others require application of brakes within a minimum time interval as assurance that a more restrictive condition is recognized by the crew. Some more refined ATC systems also have a target speed associated with certain of the aspects and enforce the reduction in speed until the target speed is reached. In any of these enforcements, the consequence of an engineer failing to respond in the proper manner is an automatic penalty brake application which generally forces the train to come to a full stop before the engineer is able to regain manual control of the brakes and begin moving again.

Some high density passenger railroads involved in commuter or transit operations use the cab signal coded information exclusively to display an authorized speed to the engineer, rather than a pattern of lights conveying block status. The number of speeds that may be displayed is limited to the number of codes available in the wayside equipment, which is typically from three to six. This essentially prevents the use of these codes for conveying speed limits for any purpose other than nominal values resulting from changes in signal aspects. However, a railroad line typically has a number of areas, such as curves and bridges, where fixed civil speed restrictions are imposed for safety, but automatic indication and enforcement of such speed restrictions is outside the scope of a conventional cab signal system.

Furthermore, except on the high density passenger lines, a cab signal system has also not been able to convey enough information to indicate when an absolute stop is required, due to a potential conflicting route situation, as opposed to a "restricted speed" type of movement in which one train may be following another and be required to operate on visual rules at a speed slow enough to be able to stop short of another train, obstruction or open track switch. Inability to make this distinction of course prevents the conventional system from enforcing a complete stop ("positive" stop) at the proper location. Since these stops cannot be enforced, there are accidents occasionally, even in cab signal territory, caused by a train crew inadvertently running past a stop signal and into the path of another train.

Additionally, since train operations often span several rail lines having different cab signal systems, or none at all, there is a need for a reliable automatic means for changing the operational mode of the on-board train control equipment.

SUMMARY OF THE INVENTION

It is, therefore, a general object of the present invention to provide a train control system which overcomes the shortcomings of existing systems discussed above by enforcing fixed speed restrictions independently of speed reductions called for by the wayside block monitoring logic, by targeting the exact location on the track where a stop or reduced speed is required, and by providing enforcement of positive stops when required.

In addition to this general objective, it is an important object of this invention to provide such a system in which dynamic data concerning track availability and routing is transmitted to the train, fixed data appropriate to preselected locations along the track is also transmitted to the train, and the received dynamic and fixed data are integrated and train control instructions determined therefrom.

As a corollary to the preceding object, it is an important aim of this invention to provide localized transmitting units spaced along the track at preselected locations, each of which has means for transmitting the fixed data appropriate to the respective location including speed limit information which is fixed and remains constant.

Another important object is to provide for the transmission of fixed data at successive locations along the track which includes information defining a point along the track at which a speed restriction is in effect.

Still another important object of the invention is to provide a system as aforesaid in which the transmitted dynamic data may include a train separation speed limit, and wherein control over the train is accomplished by comparing the separation and fixed speed limit information received by the train and providing a target speed instruction at the value of the lower of the two speed limits.

Yet another important object is to provide such a system in which the distance within which the train must change its speed in response to an upcoming speed restriction is determined on board the train based on the data received.

Furthermore, it is an important object of the present invention to provide a train control system employing localized, fixed data transmitting units along the track wherein certain of the units are located at block boundaries and include in the transmitted data an identification of the block boundary that a train is passing.

Another important object of the invention is to provide a train control system having automatic means for changing the operating mode of the on-board control equipment when the train enters a block or stretch of track which is controlled by a different cab signal system, or passes from controlled to uncontrolled blocks.

Another important object is to provide a train control system in which dynamic and fixed data is received by the train and integrated in the on-board computer to indicate and enforce a positive stop at a specific location when required.

Still another important object of the invention is to provide a train control system of the type set forth hereinabove which discriminates between the end of a speed restriction that applies only to the head end of the train, and the end of a speed restriction that applies to the entire train and requires the train to travel a distance equivalent to its length before the restriction is removed.

Yet another important object is to provide a train control system having the capability of including multiple values for current speed limit in the fixed data transmitted to a train, wherein each value is associated with a particular class of train and is exclusively recognized by trains of that class.

Additionally, the enforcement of any restrictive instructions that are not obeyed is an important object of this invention so that safety will not be compromised by the failure of a train crew to obey a restrictive instruction.

In furtherance of the foregoing objects, the train control system of the present invention transmits fixed data to the train in addition to dynamic data provided by the conventional encoded cab signals. Block status information is considered dynamic information, as that term is used herein, because it varies at any given location depending on the position and direction of movement of trains. Civil speed restrictions (also referred to herein as timetable speed limits) and the location of block boundaries are considered static or fixed information, because it is specific to a given location on the railroad and tends to be a constant as opposed to varying with time or the position of trains. In the present invention two different means of communication with the train are combined to deliver all the information needed to display and enforce all speed limits and required stops.

Dynamic data in the disclosed embodiment is transmitted to the train by means of coded currents in the rails, similar to that used for conventional cab signals. Indeed, the system can readily be overlaid on a conventional cab signal system to enhance its safety. It should also be understood that the dynamic data may be transmitted to the train by other means such as by radio from transmitting sites along the track.

Fixed data is conveyed to the train by means of transponders placed on the track at selected locations. The transponders are passive electronic transmitters which are powered very briefly by energy radiated from an antenna on a passing train, and when so powered, transmit a unique message back to the train-carried antenna. This unique message consists of several parts, depending on the location and purpose of the transponder, and will include information concerning the location of adjacent transponders, location of block boundaries, and speed limits. Computer equipment on the locomotive receives the information from the transponders, combines it with the dynamic information received from the cab signal system, and determines the current speed limit and the distance to any upcoming reduction in speed if that reduction is close enough to be of interest. The resulting train control instructions as determined by the on-board computer are displayed by a cab signal aspect display and an engineer's speed limit display for use by the train crew.

The train control instructions are also enforced by speed enforcement logic using inputs from axle tachometers on the locomotive to monitor axle rotation, which is readily converted into values of distance travelled and speed of motion. Monitoring the position of the reverser lever in the control cab determines the relative direction of motion. Using the receipt of a transponder message at a block boundary as a location reference, the enforcement computer measures the distance travelled since passing that transponder so that any dynamic data that requires action to be taken upon reaching the next block boundary may be enforced at the exact location. By the same means, civil speed limits are marked by transponders at a sufficient distance in advance that a train has time to reduce speed before reaching the location where the speed restriction is in force. The system measures the distance travelled from the advance warning transponder and enforces the speed restriction at the proper location. Enforcement occurs by comparing actual speed as taken from the axle tachometer with the required speed, as calculated by merging the cab signal and transponder information, and if the train is exceeding that speed, a penalty brake is automatically applied.

Reductions to a lower speed are indicated by displaying the required target speed on the engineer's display in the cab. Progress in reducing to that speed is compared with information stored internally in the on-board computer which determines the proper speed-distance profile required to reduce from the original speed to the target speed. So long as the speed of the train is less than that required by the profile at any given point, even though it is greater than the target speed, the train is allowed to continue under manual control. If the crew fails to keep the actual speed under the internally determined profile, a penalty brake is applied and the train is brought to an automatic stop.

A requirement for a positive stop may be identified by a unique cab signal code to indicate approach to a positive stop signal as opposed to one at which passage at slow or restricting speed is permitted. This provides the dynamic input to the train to identify the need for, but not the exact location of, a positive stop. However, to accomodate existing cab systems in which such a code is not available, in the present invention a positive stop is identified by a special section of the message sent by the transponder at the last block boundary before reaching the positive stop signal; this message identifies the next signal as one at which the most restricting aspect requires a positive stop, as well as specifying the distance to that signal. These two pieces of information are integrated in the on-board computer to indicate and enforce the positive stop at the proper location. Default reactions are predefined to cover situations involving some form of failure to read either the transponder message or the cab signal information, so that a safe result is obtained.

The system of the present invention is also capable of enforcing speed restrictions applying to the entire train as opposed to the head end only. For example, restrictions imposed due to track curvature or to taking a diverging route through a track switch require that the entire train pass through the restricted area before the train resumes speed. This is difficult to judge manually. The disclosed system includes a means by which the train crew may manually enter a numerical value representing the train length into the locomotive computer. A transponder marking the end of a speed restriction will include in its message an indicator of whether the restriction applies to the entire train. If it does, the locomotive computer will require the train to travel a distance equivalent to its length before the speed restriction is allowed to increase. If the restriction applies to the front end only, the speed restriction will be allowed to increase to the new value as soon as the locomotive has passed the transponder marking the change.

Another feature is the ability to include in a speed restriction transponder message multiple values for current speed limit, each associated with a particular class of train. For example, certain types of freight trains may be required to operate at slower speeds than passenger trains, or locomotive-hauled trains on a commuter line may have more restrictions than multiple-unit self-powered cars. The present invention provides for a train class or equipment type to be defined either in the inherent installation of the computer equipment on a given type of locomotive or transit vehicle, or by manual input by the train crew in a manner similar to entering train length. Once this class or type is designated, the train will respond to the speed restrictions designated as belonging to that class of train or equipment. In the absence of any class or type designation, the lowest of the speed values contained in a multiple-value message will be used.

THE CONTROL SYSTEM IN GENERAL

Figure 1:
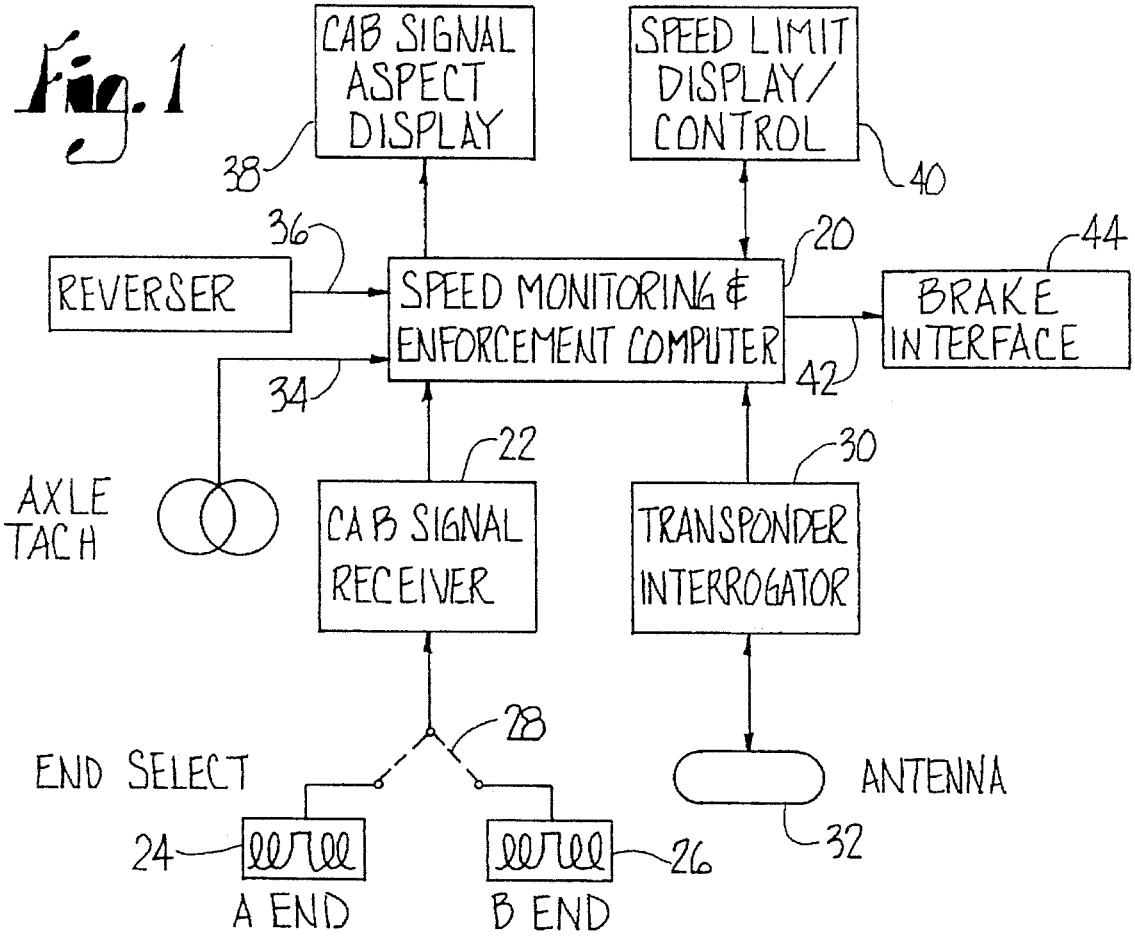
FIG. 1 is a block diagram of the train control system of the present invention.

FIG. 1 is a block diagram showing the function and interrelationship of the components of the system of the present invention located on board a train. In the locomotive a speed monitoring and enforcement computer 20 receives coded cab signals detected in the illustrated embodiment by a cab signal receiver 22 which has its input connected to either one of a pair of inductive pickup coils 24 and 26 located just above the rails and ahead of the lead wheels, the particular coils being selected by an end select switch 28. The cab signal receiver 22 decodes the dynamic data concerning track availability and routing and feeds such information to the computer 20. The hardware components of computer 20 include a central processing unit (CPU), a read only memory for program storage, a random access memory for storage of transient data derived from the input dynamic and fixed data, interfaces to the inputs and outputs of computer 20 shown in FIG. 1 and described herein, and internal self-testing hardware and software.

Passive beacon transponders are located along the track at block boundaries and other appropriate locations (FIGS. 4, 5 and 7) and are interrogated by a passing train, this being accomplished by a transponder interrogator 30 having an antenna 32 mounted adjacent the underside of the locomotive. Each of the transponders is of the general type disclosed in U.S. Pat. No. 4,711,418 and, when interrogated, responds with a serial data message bearing fixed data appropriate to the respective location, such as a location identification number, timetable speed limits, distance to the next transponder, etc. as will be discussed in detail hereinbelow. This fixed data is read by the interrogator 30 and fed to the computer 20 where it is integrated with the dynamic data from the cab signal receiver 22 so that the computer may determine the proper train control instructions. Other inputs to the computer 20 that bear upon the nature of the train control instructions comprise an input 34 from axle tachometers on the locomotive and an input 36 which monitors the position of the reverser lever in the control cab so that the computer is made aware of the direction of movement of the train. Information from the axle tachometers is, of course, readily converted into distance travelled and speed of motion of the train for use by the speed enforcement logic.

Figure 2:
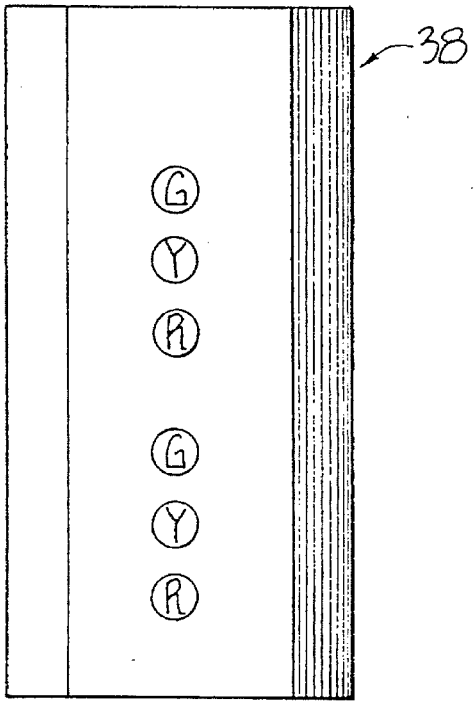
FIG. 2 is a front view of the cab signal aspect display.
Figure 3:
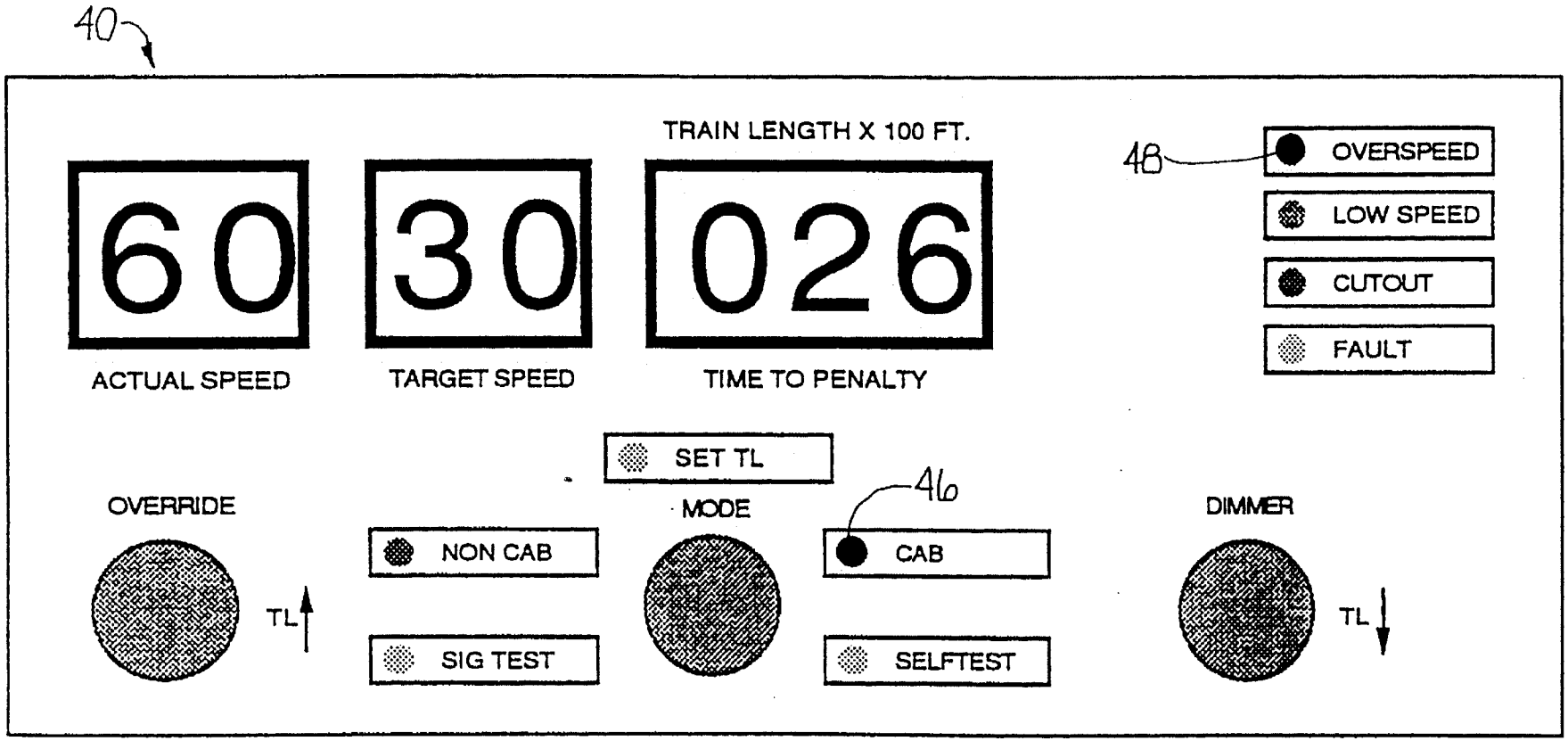
FIG. 3 is a view of the front panel of the engineer's display.

The train control instructions are conveyed to the train crew by an aspect display unit 38 located in the cab (see also FIG. 2) and an engineer's display 40 shown in detail in FIG. 3. The display 40 shows the engineer the "actual speed" that the train is currently travelling, a "target speed" in response to an upcoming speed restriction, and a "time to penalty" designated in seconds which informs the engineer of the time remaining before a penalty brake will be applied if the train continues at its present speed. The penalty brake command is delivered by removing a vital output 42 of the computer 20 to a brake interface 44.

One type of aspect display unit 38 is illustrated in detail in FIG. 2 and shows the same pattern of lights as used on wayside signals but has the obvious advantage of continuously informing the engineer of the signal aspect. The upper set of three lights are green G, yellow Y and red R from top to bottom, as are the lower set of three lights. For example, in accordance with a typical aspect convention, a CLEAR aspect is green over red (G/R), meaning that the green light of the upper set is illuminated and the red light of the lower set is illuminated. The opposite condition, a STOP aspect, is red over red (R/R). Other aspects are denoted by the standard light combinations as employed in wayside signals.

GENERATION OF DYNAMIC AND FIXED DATA

Dynamic data is generated by the wayside signal system based on routing and track availability and is furnished to the train preferably by means of a modulated 40 Hz carrier in the rails. Different modulation rates are used to convey different states which are converted in the on-board computer 20 to cab signal aspects. When a change to a more restrictive aspect occurs, the on-board computer 20 calculates a braking profile and displays this to the train crew by indicating target speed and time-to-penalty on the engineer's display 40.

Fixed data is predetermined in accordance with track geography and is stored in the beacon transponders, typically mounted between the rails, which are interrogated by a 200 KHz signal from the antenna 32 and respond at a carrier frequency of 27 MHz. All transponders are physically identical and fixed coded, i.e. the code modulation is preset as there is no variable data based on dynamic conditions. A number of different message types are used depending upon the particular application. Data is varied within each message type based on local conditions at each site. Information in the message of each transponder includes data concerning the adjacent transponders so that a defective or missing transponder will not compromise the safety of the system.

SYSTEM IMPLEMENTATION

A total of five different transponder message types and five different code rates on the cab signal carrier are utilized in the disclosed embodiment of the present invention. The cab signal system is based on the use of a 40 Hz carrier to gain the advantage of extended range, but the control system is fully compatible with more traditional cab systems that use a 60 Hz or 100 Hz carrier. Modulation rates for the 40 Hz carrier are slower than some of those used at higher frequencies, because of the ringing effects of the large filters needed to couple 40 Hz to the track and block other frequencies used for grade crossing equipment. Suggested rates and the aspects associated with each are summarized in the table below and vary from the fastest rate of 75 pulses per minute to the slowest of approximately 27 pulses per minute. Except for the 50 ppm and 75 ppm rates, the modulation is non-symmetrical, i.e., the "off" time of all rates below 75 ppm is the same, 600 milliseconds. The "on" time varies from 600 msec. at the 50 ppm rate up to 1.65 seconds at the 27 ppm rate. This allows more rapid detection of a no-code condition than would be possible with a symmetrical code structure at these low rates.

Coded Cab Current Information

| Modulation of 40 Hz Carrier | MOD. RATE |
|---|---|
| RESTRICTING | 0 |
| APPROACH STOP | 75 |
| APPROACH RESTRICTING | 32 |
| APPROACH DIVERGING | 39 |
| ADVANCE APPROACH | 27 |
| CLEAR | 50 |

Figure 4:
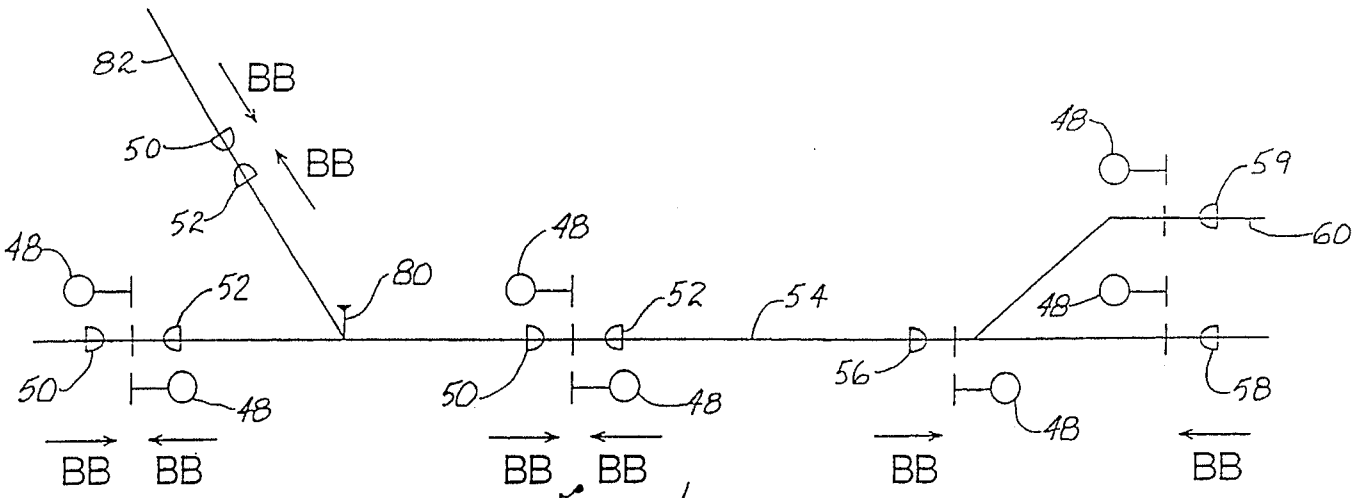
FIG. 4 is a diagram illustrating a stretch of track and showing the location of block boundary transponders.
Figure 5:
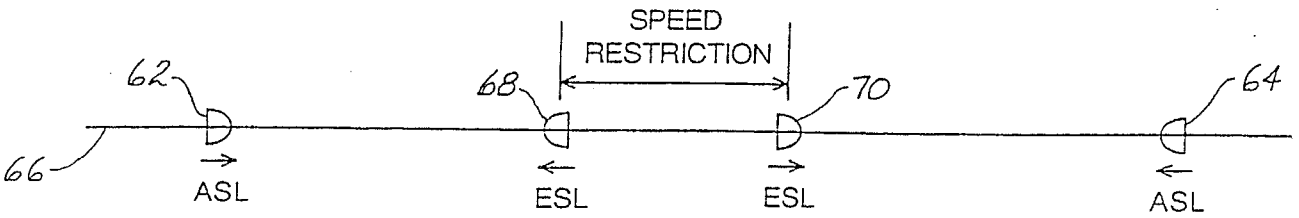
FIG. 5 is a diagram illustrating the placement of speed limit transponders at track locations at and in advance of a speed restriction.

Typical transponder placement is illustrated in FIGS. 4 and 5. The five different transponder message types do not necessarily require physically different transponders; one transponder may function in more than one role by using the proper data fields. The various message types are as follows:

1. Block Boundary—This message identifies the boundary of contiguous blocks where wayside signals 48 are located (FIG. 4) and is delivered by transponders installed in pairs at each boundary as illustrated at 50, 52 in FIG. 4. The message delivered by each transponder 50 or 52 concerns the next block ahead as denoted by the associated block boundary (BB) arrow indicating the direction of movement of a train. At an interlocking such as illustrated in FIG. 4 at the right end of the rail line 54, the transponder pair is split and comprises a transponder 56 at the left edge of the interlocking and affecting trains moving to the right, and transponders 58 and 59 on the main line 54 and the side track 60 respectively, affecting trains moving to the left. Where a mode change occurs, this is also incorporated into the block boundary message.
2. Advance Speed Limit (ASL)—This is a unidirectional message transmitted by individual ASL transponder units illustrated at 62 and 64 in FIG. 5 installed at braking distance ahead of a point of reduced speed limit on the track 66 so that a proper speed reduction can be achieved prior to the start of the actual speed limit. This is shown in FIG. 5 where a section of the track 66 in which a reduced speed limit is in effect (speed restriction) is bounded by ESL transponder units 68 and 70 discussed below.
3. End Of Speed Limit (ESL)—This is a unidirectional message transmitted by the individual ESL transponder units 68 and 70 installed at the beginning of each segment of the track 66 on which a higher speed limit is in effect (end of speed restriction). As may be appreciated from viewing FIG. 5, a train travelling from left to right would interrogate the left ASL transponder 62 and be advised by the ensuing message that a speed restriction is in effect beginning at the point represented by the upcoming ESL transponder 68. (It should be understood, however, that due to the unidirectional nature of the messages from the ASL and ESL transponders, the on-board computer 20 is not responsive to a message from the left ESL transponder 68.) The advance speed limit message from the left ASL transponder 62 advises computer 20 of the upcoming speed limit in effect at the speed restriction and the distance to the point at which the speed restriction starts (ESL transponder 68). The next transponder to which the train (moving from left to right in the instant example) responds is ESL transponder unit 70 at the end of the speed restriction, the message therefrom advising the computer 20 that the train may be instructed that a higher speed limit is now in effect. Likewise, a train coming from the opposite direction (from right to left in FIG. 5) would respond to and derive its control instructions from ASL unit 64 and ESL unit 68.
4. Odometer Calibration—This is a bi-directional message from transponder units (not shown) used in pairs but spaced a significant distance apart, typically around 2000 feet, preferably in areas where there is little likelihood of heavy braking or accelerating that might cause wheel slip or slide. Calibration transponder codes will define the actual distance and identify which unit is the start and which is the stop unit, depending on direction. The on-board computer 20 uses this information to establish the exact relationship between wheel tachometer pulses and train movement.
5. Temporary Speed Limit—This is an optional message type and is similar to the advance speed limit, but with a special code that distinguishes it as temporary. The message may be delivered by a portable transponder unit that allows it to be installed and removed by a railroad employee, but with a physical attachment means that prevents removal by the casual passerby. Trains passing this unit in the assigned direction will be bound by the reduced speed limit conveyed, the start point and end point locations of the reduced speed limit being contained as part of the message. Typically, temporary speed limit transponders would not contain data concerning distance to adjacent transponders, nor would permanently mounted transponders indicate distance to any temporary speed limit units.

As stated above, an individual transponder unit may function in more than one role. For example, the ASL unit 62 in FIG. 5 could be located at a block boundary and also deliver a block boundary message as described with reference to the block boundary units 50 and 52 in FIG. 4. Accordingly, the message transmitted by a given transponder may be composed of one or more data fields as dictated by the location of the transponder and the fixed track conditions ahead. Representative data fields are listed as follows:

1. Transponder message type(s), recognizing that more than one message type may co-exist on the same transponder. (Used in all messages.)
2. Distance to next transponder in the specified direction.
3. Direction of traffic (E/W or N/S) for which the transponder applies. Locomotives determine their direction automatically from the sequence in which the directional messages are received from transponder pairs at block boundaries.
4. Current timetable speed limit effective in the specified direction, along with the applicability of a train length restriction imposed if an increase in speed is indicated.
5. Distance to the point of next reduced speed in the specified direction.
6. Speed limit at the point of next reduced speed in the specified direction for each of three train classes.
7. Distance to next block boundary in the specified direction and the one beyond it.
8. Class of signal at next block boundary in the specified direction. This defines whether the most restricting aspect at that boundary signal is RESTRICTING or STOP, and defines the worst case speed limit of a diverging route at that signal.
9. Operating mode beyond the transponder in the specified direction.
10. Transponder ID number or other location reference number.
11. Checksum or other means of assuring message integrity.

The above data fields, grouped in accordance with the type of transponder message in which they could appear, are set forth below under the appropriate message types-block boundary, advance speed limit, end of speed limit, temporary speed limit, and odometer calibration:

Block Boundary

* Message type
* Distance to next transponder
* Pertinent direction
* Distance to next block boundary
* Distance to second block boundary
* Signal class at next block boundary
* Operating mode
* Location ID
* Checksum Advance Speed Limit

* Message type
* Distance to next transponder
* Pertinent direction
* Distance to start of reduced speed limit
* Value of upcoming reduced speed limit (up to 3 values)
* Train class associated with each speed value
* Checksum End Of Speed Limit

* Message type
* Distance to next transponder
* Pertinent direction
* Current speed limit (up to 3 values)
* Train class associated with each speed value
* Train length restriction
* Checksum Temporary Speed Limit

* Message type
* Direction
* Distance to start of reduced speed limit
* Distance to end of reduced speed limit
* Value of reduced speed limit
* Checksum Odometer Calibration

* Message type
* Distance to matching calibration transponder
* Direction
* Checksum Interaction between the data inputs is based on accepting and enforcing the lower of the authorized speeds as received from the transponders or from the cab signal system. In the present invention a train receiving a downgraded cab signal aspect will always know how far it is from the next block boundary at which the cab aspect's speed limit will apply, and the class of signal at that boundary. Based on that information, it will know the proper target speed, use current speed as the initial or entry speed, and select or compute the braking curve, adjusting the entry delay time as needed to make the target speed fall at the proper target location. If a train receives an upgraded cab signal aspect from APPROACH to CLEAR, the system will immediately display and permit the higher limit. On most other aspect upgrades, the higher speed will be displayed and permitted only after the train has travelled its length from the point where the upgrade occurred.

Braking curves are based on the predetermined worst case combination of factors, so all trains are treated herein as worst case trains. In practice, some modification of this may be possible based on train length or other factors as a modifier for braking curve calculation, if safety implications can be satisfied.

Figure 6:
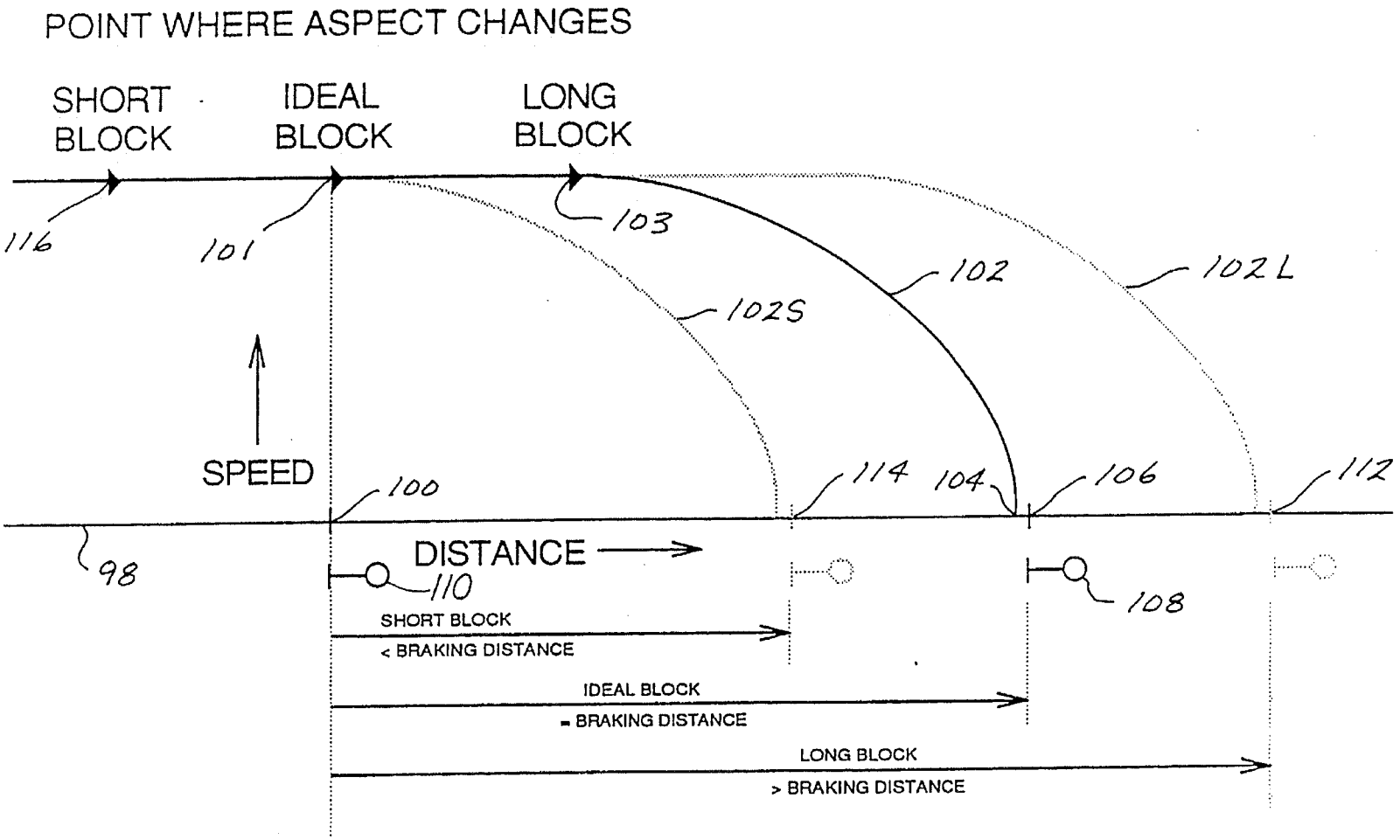
FIG. 6 illustrates the adjustment of a braking curve for varying block length.

Assuming that block lengths are not necessarily the same as worst case braking distance, the information provided by the transponders to define block boundaries is used to adjust the starting point for braking so that the completion of braking will fall at the correct location. FIG. 6 illustrates compensation for block lengths that are either too long or too short for the required braking curve to execute a full stop at or near the end of the block. Blocks that are too short require the ADVANCE APPROACH cab aspect to be displayed in the previous block when a stop is required, and this aspect combined with the block boundary distance information from the transponders determines at what point the actual braking must begin. The crew is advised of this by means of the time-to-penalty indication on the engineer's display 40 (FIG. 3).

Referring to FIG. 6, a boundary of an ideal block is represented at 100 on track 98, and an arrow head 101 indicates the initiation of a braking curve 102 representing the decreasing speed of the train to zero (full stop) at 104 just short of the next block boundary 106 and accompanying wayside signal 108 which is displaying the STOP aspect. At the beginning of the ideal block, the wayside signal 110 at boundary point 100 displays the APPROACH aspect and an earlier warning is not required because the length of the ideal block is sufficient to accomodate the braking curve 102.

If the block is longer than required to stop the train, then the starting point for braking is adjusted to 103 so that the braking curve 102L (broken line) also completes braking just short of the next block boundary 112. Similarly, compensation for a short block results in displacement of the braking curve as shown at 102S to stop the train near the next block boundary 114. A short block will, of course, require that the ADVANCE APPROACH aspect be displayed in the previous block in preparation for the beginning of braking at point 116 in advance of the block boundary represented by wayside signal 110.

As will be appreciated in the section of this specification hereinbelow directed to the computer software, the hypothetical speed of a train at any given instant along braking curve 102, 102S or 102L is the transient target speed (TTS). The final target speed (TS) is indicated on the engineer's display 40 (FIG. 3) at the beginning of the braking instruction, i.e., point 100 in an ideal block, point 116 for a short block, and point 103 for a long block.

When a train encounters a timetable speed restriction conveyed from an ASL transponder message, computer 20 will determine target speed and target distance from the transponder message, use current speed for the entry speed, and select or compute the braking curve with adjustments in the initial delay time to reach the target speed at the target location. When a train encounters an increase in authorized timetable speed, it may be required to run one train length before the displayed and enforced speed limit is increased to the new level. This requirement is specified in the train length restriction data field in the message from the ESL transponder. An illustration of this is given in FIG. 7 and is discussed below.

Obviously the timetable and cab signal authorized speeds will generally not be the same. The cab signal system has no single speed associated with a CLEAR aspect, so with that aspect received the timetable speeds would be used. The more restricting cab signal aspects each have a corresponding final target speed, and the system will display and enforce as a target speed either the timetable speed or the cab signal speed, whichever is the lower. If either the cab signal or the timetable speed calls for a braking curve to a lower speed, that speed will be displayed as the target speed and that braking curve will be used for enforcement. If circumstances result in two different braking curves being in effect at the same time, one for a cab signal downgrade and one for a timetable speed downgrade, whichever one applies first will be in effect for the initiation of braking and the target speed will be the lower of the speed restrictions.

A mode change function changes the operating mode of the system. The system has four primary operating modes, defined as follows:

Mode A: ATC with Dynamic Plus Fixed Data

This applies in areas where both dynamic cab signal data and fixed data from locations along the track are provided.

Mode B: ATC with Dynamic Data Only

This applies in areas where dynamic cab signal data is provided, but not the fixed wayside data.

Mode C: ATC with Fixed Data Only

This applies in areas where fixed wayside data is provided, but no dynamic cab signal data.

Mode D: Non-ATC

This applies in areas where there are no wayside facilities or elements to support the ATC system.

Modes B and D will cause the system to use the last received civil speed limit and latch it in memory as the one not-to-exceed speed value until another mode change message is received.

Modes A and B may be further refined into sub-modes A1, A2, . . . or B1, B2, . . . which define the particular format and interpretation of the dynamic information being transmitted as might be required, for example, by different carrier frequencies and/or code rates.

THE ENGINEER'S DISPLAY

The engineer's display 40 in FIG. 3 includes a number of controls that adapt the display to the system of the present invention. The "MODE" select button allows selection of self test, cab signal (SIG) test or train length (TL) set mode. The "DIMMER" switch button allows display brightness to be set in the usual manner, but also allows the engineer to set the train length TL (decrease length) when the selected mode is the train length set mode. The "OVERRIDE" button allows manual override of an enforced stop in combination with actuation of the acknowledgement pedal (not shown) when the train is stopped; it also sets train length TL (increase length) when in train length set mode.

The displayed indications include the following:

"ACTUAL SPEED"—Taken from axle tachometer.

"TARGET SPEED"—Calculated from transponder data and cab aspect.

"TIME TO PENALTY"—Calculated from transponder data, actual speed and internal braking curve algorithms and shown in seconds.

Train length—Shown on time-to-penalty display when in set train length mode. Length is shown in hundred feet.

Diagnostic messages—Shown on time-to-penalty display as needed.

Mode—"CAB" or "NON CAB" based on transponder input; CAB indicates operating Mode A or B, and NON CAB indicates Mode C or D. "SELFTEST," cab signal test ("SIG TEST") and train length set ("SET TL") modes reflect manual selection.

Motion status—"OVERSPEED" indicates speed exceeds target speed. "LOW SPEED" indicates motion essentially stopped (less than 3 mph). "CUTOUT" indicates unit has been cut out of service. "FAULT" indicates some error condition, identified by error message on time-to-penalty display.

The conditions illustrated by the status of display 40 shown in FIG. 3 are 60 mph actual speed, a target speed of 30 mph, time to penalty of 26 seconds, cab mode (indicator lamp 46 illuminated), and overspeed motion status (indicator lamp 48 illuminated).

Figure 7:
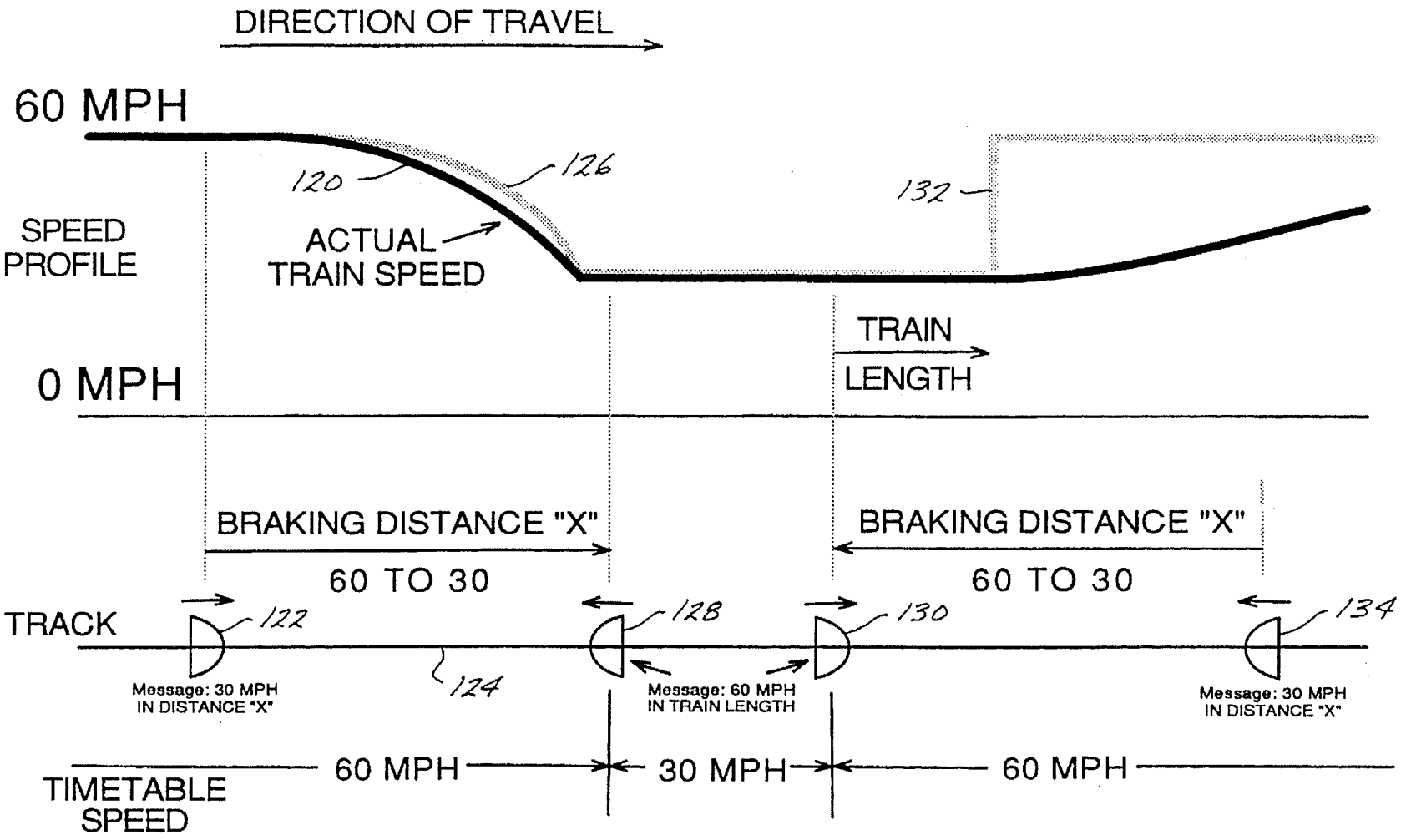
FIG. 7 is a diagram illustrating the operation of the system and train speed over a stretch of track having a 30 mph speed restriction.

An example of a situation on the track which would cause the engineer's display 40 to show 60 mph actual speed and a target speed of 30 mph is illustrated in FIG. 7. The speed profile curve is shown at 120 (dark line) responding to an ASL transponder 122 at a location on track 124 in advance of a 30 mph speed restriction. The transponder message indicates that a reduction to 30 mph is required in distance "X". The engineer's display 40 responds by indicating a target speed of 30 mph. The braking curve that is initiated is illustrated at 126 (broken line) and requires that the speed of the train be reduced to 30 mph just short of a location marked by an ESL transponder 128. The speed value along curve 126 is the transient target speed TTS and represents the maximum speed that the train can travel and still satisfy the braking curve. Train speed greater than TTS results in a time to penalty indication of zero on the engineer's display 40 and would initiate the penalty brake, thus the engineer is required to maintain the train within the curve 126 as illustrated by the actual train speed curve 120.

Once the 30 mph restriction has passed as indicated by the message from an ESL transponder 130 at the location along the track 124 where the speed restriction ends (for trains moving to the right), the target speed remains at 30 mph for a distance equal to the length of the train, at which point the restriction is removed as illustrated by the vertical excursion 132 to the 60 mph level. This illustrates the application of a train length restriction (TLR) discussed below with reference to FIG. 12. Similarly, for trains moving from right to left, an ASL transponder 134 delivers the speed restriction message and the ESL transponder 128 advises that the speed restriction has ended subject to the TLR.

AN ILLUSTRATIVE RUN

An illustration of a train operating under the control system of the present invention is set forth in the following example. All speed limits are arbitrary numbers used for illustration purposes only.

A train with an equipped locomotive is made up in a yard. All engine movements within the yard are conducted in non-cab mode (Mode D), with an enforced maximum speed of 20 mph. When it leaves the yard and approaches the main line, it passes a block boundary transponder that transmits mode change data and puts the train into Mode C. In this mode, transponder data will display and enforce timetable speed limits, but train separation is the responsibility of the engineer based on signal aspects or other authority. As the train proceeds over the territory, each increase in authorized speed is transmitted to the train by an ESL transponder as it reaches the border where the new limit applies; each decrease in authorized speed is transmitted to it by an ASL transponder far enough in advance of the new limit that a proper braking curve may be used to reach the new limit.

If the train enters a territory where cab signaling is in use along with fixed data as described herein, a block boundary and mode change transponder switches the system into cab mode (Mode A) and requires cab signal codes from the track to convey operating conditions. In this mode, so long as CLEAR aspects are received, the timetable speeds will be displayed and enforced. If an APPROACH aspect is received, block length data from the last block boundary transponder will be used to determine the distance in which the target speed must be reached, and signal class data from that same transponder combined with the type of approach code received will determine whether the braking will be carried out to a full stop (in the case of approaching a home signal at stop) or to a restriction (in the case of approaching an intermediate signal or block point, or a home signal at restricting or slow). If an APPROACH DIVERGING aspect is received, block length data will be used to determine the distance in which the target speed must be reached, and signal class data will determine the target speed based on the lowest diverging route speed at that location. In each case, the result of the exit speed determination will be displayed as a target speed on the engineer's display 40 and the distance will govern the time to penalty indicated. The necessary braking curve to achieve that target will be enforced.

If any block lengths are shorter than worst case stopping distance, an ADVANCE APPROACH aspect will be displayed in the previous block to provide an early start on braking. The system will determine the distance to the point of the target speed based on "current block length" and "next block length" data from the block boundary transponders, and adjust the initiation of the braking curve accordingly.

If timetable speed reductions are required in this territory, they will be utilized in combination with the cab signal speed commands and the more restrictive of the two requirements will be displayed and enforced.

If any transponder other than a temporary speed limit unit fails to communicate with a passing train, that train will recognize the absence of data and will initiate a speed reduction to a predetermined level. This reduction will be maintained until another transponder is read and a new authorized speed can be determined.

If a train or engine enters the main line at a hand operated switch such as illustrated at 80 in FIG. 4, with or without electric lock, a pair of block boundary transponders on the side track (illustrated at 82 in FIG. 4) provide information to the computer 20 concerning the operating mode of the territory being entered, the speed limit in the territory, the distance to the next block boundary in each direction, and the class of signal to be encountered when the train gets there. The computer 20 correlates this information with the direction of motion (reverser input 36) as it passes over the transponders. When the engine arrives on the main line, whichever direction it goes, it knows the distance to the block boundary. Depending on the cab signal code being received by the train, its speed on approach to the boundary is enforced in the same manner as if it had entered the block from the opposite end. Therefore, it cannot "sneak" onto the railroad and bypass any of the protective features of the system.

THE COMPUTER SOFTWARE

The software employed with the on-board computer 20 is illustrated by the flow charts comprising FIGS. 8–13 and the descriptions of the routines hereinbelow. A number of variables will first be defined in order that the descriptions of the routines and the flow charts may be understood. Each of these variables is given a name (abbreviation) and a particular definition. A variable listed below with the name enclosed in square brackets [] is an initial value for a variable that is either read in from an external source (transponder message or cab signal code), or calculated. In the case of speed limits, the [] designates the value received from outside, and the internal working value of the speed limit is shown without brackets []. This provides a means to illustrate comparing the working value against a newly received value. The [] designator is also used for initial values of distances which will increase or decrease with train movement; in these cases, the variable which is being increased or decreased is shown with the name underlined. Used in an equation, the underlined variable represents the instantaneous value at the time the comparison or calculation is made.

Received information representing dynamic data (such as from the cab signal system or alternate source) comprises an "aspect" which carries a speed limit and an instruction. The speed limit and the instruction may be treated separately.

| Variable Name | Definition |
|---|---|
| BD | Braking Distance required to reduce from CS to TS (Calculated on vehicle.) |
| CS | Current Speed (Measured on vehicle.) |
| CSL | Civil Speed Limit (Direct input from transponder.) |
| DBB1 | Distance to First Block Boundary (Direct input from transponder; decreases with motion.) |
| DBB2 | Distance to Second Block Boundary (Direct input from transponder; decreases with motion.) |
| DCSL | Distance to Civil Speed Limit (Direct input from transponder; decreases with motion.) |
| DNT | Distance to Next Transponder (Direct input from transponder; decreases with motion.) |
| DNTV | Variant permitted in DNT (Calculated on vehicle; used to determine a missed transponder.) |
| DSB | Distance to Start of Braking (Calculated on vehicle when a speed reduction is called for. It is equal to the value of DSCB or DSSB, whichever is lower.) |
| DSCB | Distance to Start of Braking (For CSL) (Calculated on vehicle (DTS - BD). Decreases with motion. Rests at some large default value when no braking is called for. Becomes negative when in braking curve.) |
| DSSB | Distance to Start of Braking (For SSL) (Calculated on vehicle (DTS - BD). Decreases with motion. Rests at some large default value when no braking is called for. Becomes negative when in braking curve.) |
| DSSL | Distance to Separation Speed Limit (Calculated on vehicle; decreases with motion.) |
| DTA | Distance Travelled since Aspect Change (Resets to zero when aspect changes. Increase with motion in consistent direction. Change of direction results in decrease with motion.) |
| DTT | Distance Travelled since last transponder (Resets to zero at transponder. Increases with motion in consistent direction. Change of direction results in decrease with motion.) |
| DTS | Distance to Target Speed (Calculated on vehicle; decreases with motion.) |
| NSC | Next Signal Class (One of several status types taken from transponder.) |
| OST | Over-Speed Tolerance (Tolerance over Target Speed which vehicle is permitted to travel, without penalty brake being imposed. Generally set at 2 mph.) |
| SSL | Separation Speed Limit (Speed Limit for train separation; Calculated on vehicle from cab signal code.) |
| TL | Train Length (Length measurement entered manually by operator on board.) |
| TLR | Train Length Restriction (Yes/no status taken from transponder or from cab signal code.) |
| TS | Target Speed |

-continued

| Variable Name | Definition |
|---|---|
| | (Calculated on vehicle from all available data.) |
| TTS | Transient Target Speed (A decreasing instantaneous speed value that represents points on the calculated speed/distance curve. For every value of distance travelled since the start of braking, a value of TTS is determined which must not be exceeded at that distance.) |

Figure 8:
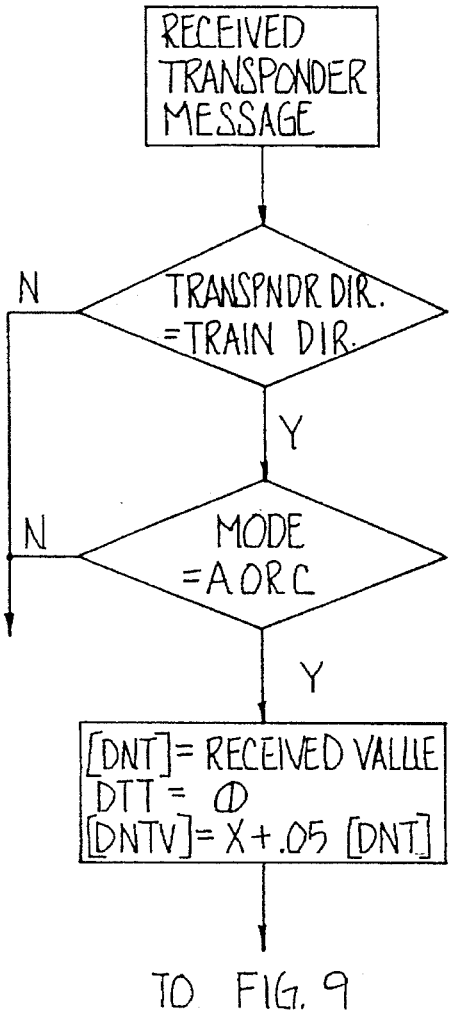
FIGS. 8–13 are flow charts of the software that executes the processing of the received fixed and dynamic data and the determination of train control instructions therefrom.
Figure 9:
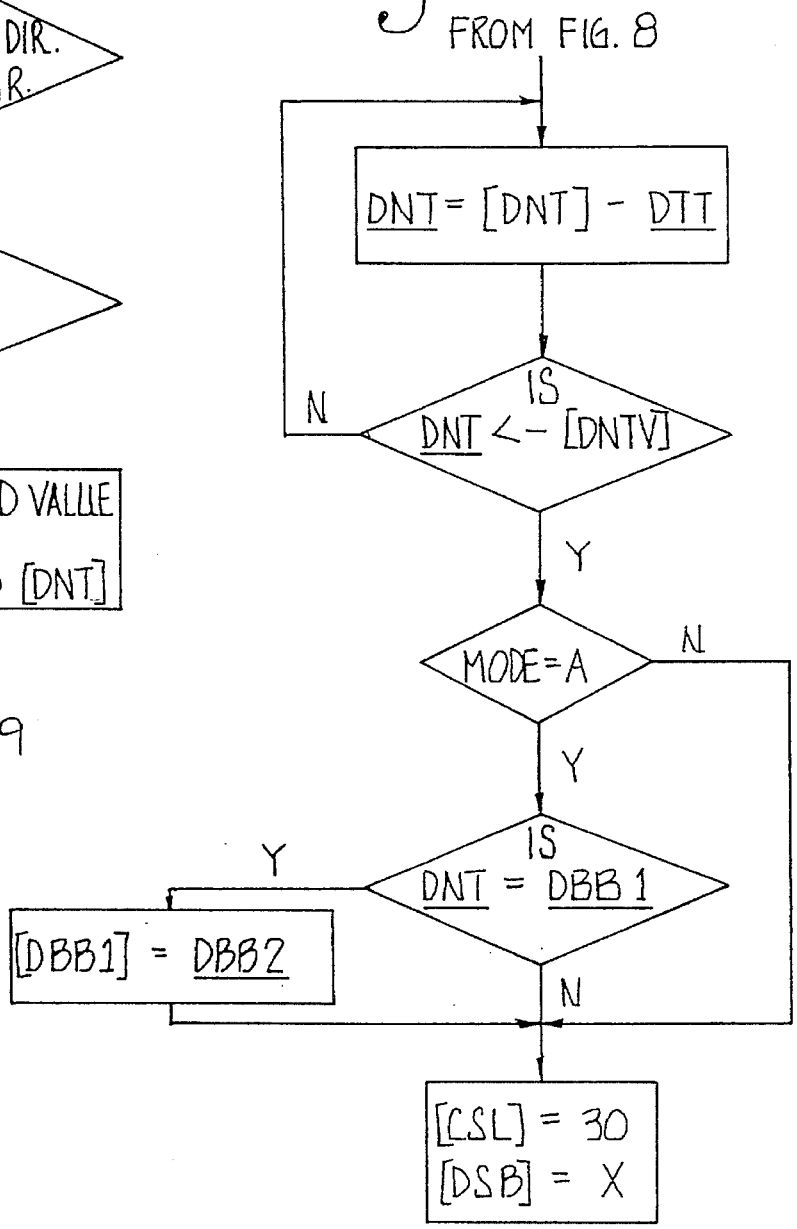

With reference to the flow charts, the routine shown in FIG. 8 runs whenever a transponder message is received. First the direction code from the message is checked to see if it matches the direction of the train. If not, the next step is not taken. If it does match and the operating mode is Mode A or Mode C, the system reads from the message the new value for [DNT], distance to the next transponder in that direction. At the time such a message is received, the Distance Travelled from Transponder variable DTT is reset to 0 and a new variance value [DNTV] is calculated at 5% of the total [DNT] plus a constant. If the operating mode is Mode B or Mode D, there will be no further transponder messages until the next mode change, and the distance computation is bypassed.

On a continuing basis while the train moves in Modes A or C, DTT increases and DNT is recalculated. See FIG. 9. If measurements are accurate, the next transponder should be passed at the same time that DNT reaches 0. Allowing for small error in calibration, wheel slip/slide or other variations, the system continuously compares the decreasing value of DNT with the variance value [DNTV]. If a negative value of DNT falls below the negative value of [DNTV], it is assumed that a transponder was missed. At that point, if operating in Mode A, DNT is compared to DBB1. If they are equal, the missed transponder was a block boundary transponder, and the new value for Distance to Next Block Boundary [DBB1], which would have been taken from the transponder had it not been missed, is taken from the current value of DBB2. There is no new value for DBB2. If the value of DNT did not equal DBB1, or if not operating in Mode A, the missed transponder was not a block boundary transponder. Assuming that it may have been an Approach Speed Limit transponder, a conservative assumption is made concerning the possible resulting speed, and this default value (shown as 30 mph in this example) is taken as the new value for [CSL]. An arbitrary default value (X) is assigned for the default initial Distance to Start of Braking [DSB]. The reaction proceeds as though a new Speed Limit message was received, diagrammed in FIG. 11.

Figure 10:
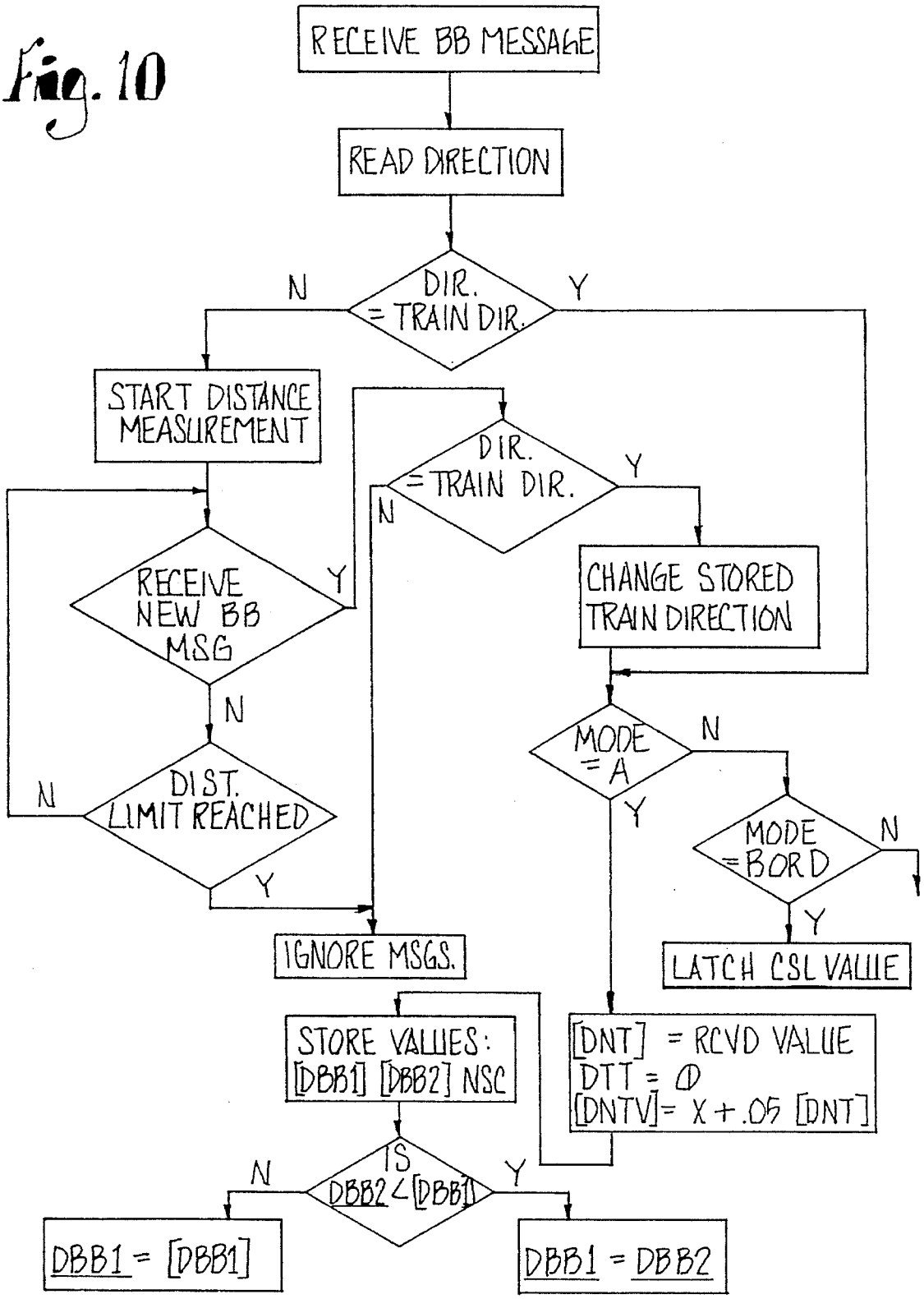

Referring to FIG. 10, when a new message is received from a block boundary transponder, the direction code is compared to the direction of the train. If the direction agrees and the system is operating in Mode A, the message is stored in memory, including new values for [DBB1], [DBB2], and NSC. New values of [DNT], [DNTV], and DTT are determined as shown in FIG. 8. If all measurements are accurate, the new value [DBB1] should equal the decreasing previous value DBB2. Any difference suggests an error in the actual values coded in the transponders, or a error in reading the values. These two values are compared, and the new starting value of [DBB1] is taken as the smaller of the two.

If the direction code does not agree with train direction, a short distance measurement is made during which the system looks for another Block Boundary message. If none is received within the distance limit, the initial message is ignored. If a new message is received and the direction code in it also does not agree with the train's direction, it and the initial message are ignored. However, if the second message, received during the distance limit, does match the train direction, it means the train has changed direction, and the stored direction on the train is changed to match the direction code in the first transponder. At that point if operating in Mode A, the new values of [DNT], [DNTV] and DTT are determined as described with respect to FIG. 8. Also, [DBB1], [DBB2] and NSC are stored in memory as described above and the same calculations take place. If the system is in Mode B or D, the last received value of CSL is latched for permanent use until the next mode change.

Figure 11:
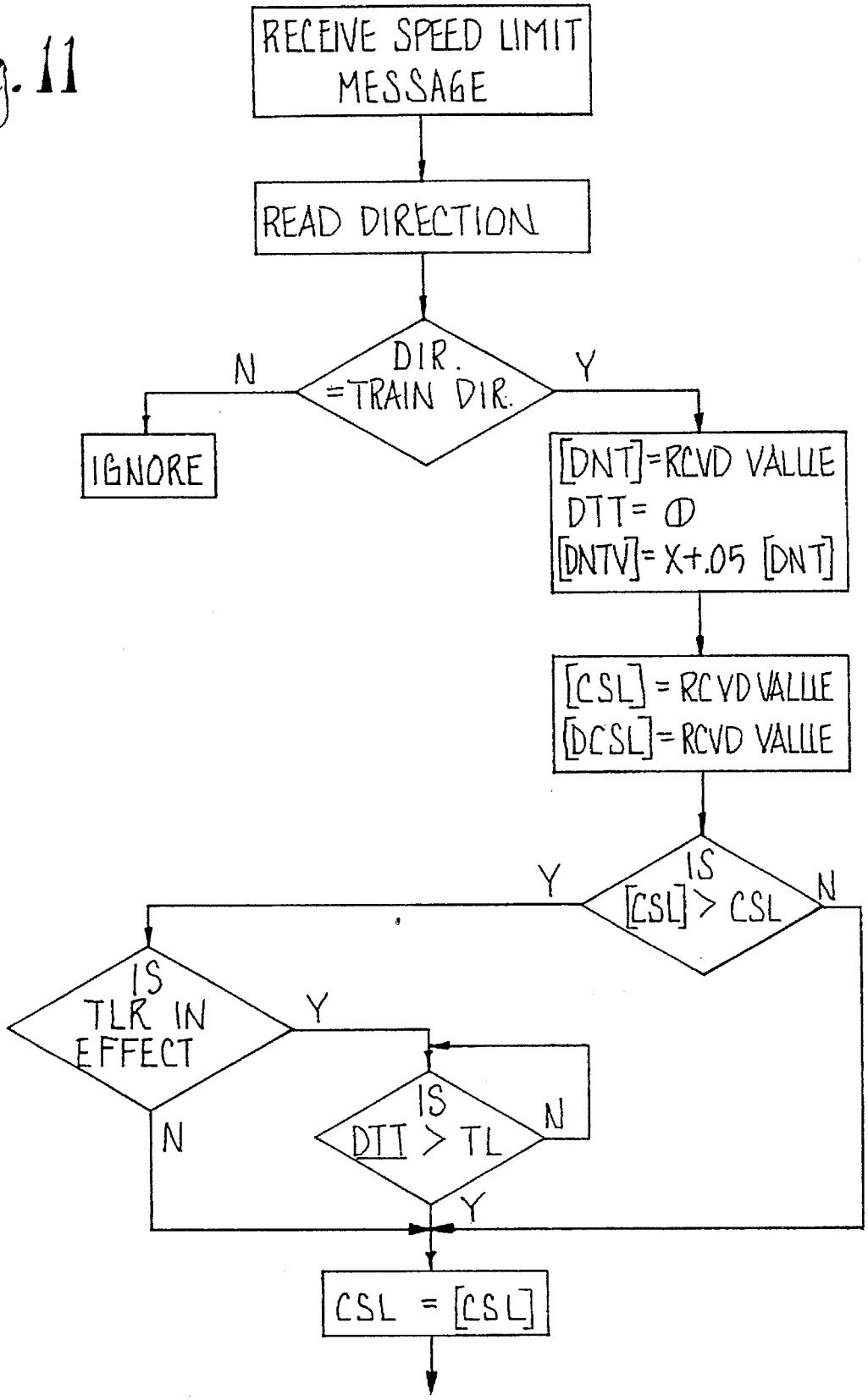

The routine shown in FIG. 11 runs whenever a message is received from a speed limit transponder, either the Advance Speed Limit or End of Speed Limit message. First the received direction code is compared to the stored train direction. If they do not agree, the transponder message is ignored. If they do agree, the [DNT] value is stored and associated calculations made as described in FIG. 8.

The message received from either type of transponder includes a new value of Civil Speed Limit [CSL] for each class of train, and a new value for Distance to Civil Speed Limit [DCSL]. Though not shown in the flow chart, it is understood that the CPU of computer 20 responds only to the speed corresponding to the proper train class. If this new value is greater than the previous value of CSL, the system checks to see if the message included a Train Length Restriction TLR marker. If it did, the previous value of CSL is maintained until the train has travelled its own length from the transponder location, determined by comparing Distance Travelled from Transponder DTT to the stored value of Train Length TL. When these are equal, the value of CSL is changed to the last received value [CSL]. If the Train Length Restriction TLR is not in effect, or if the new limit [CSL] is not greater than the previous limit CSL, CSL is set immediately at the new value [CSL]. The output of this routine is a working value for CSL and DCSL.

Figure 12:
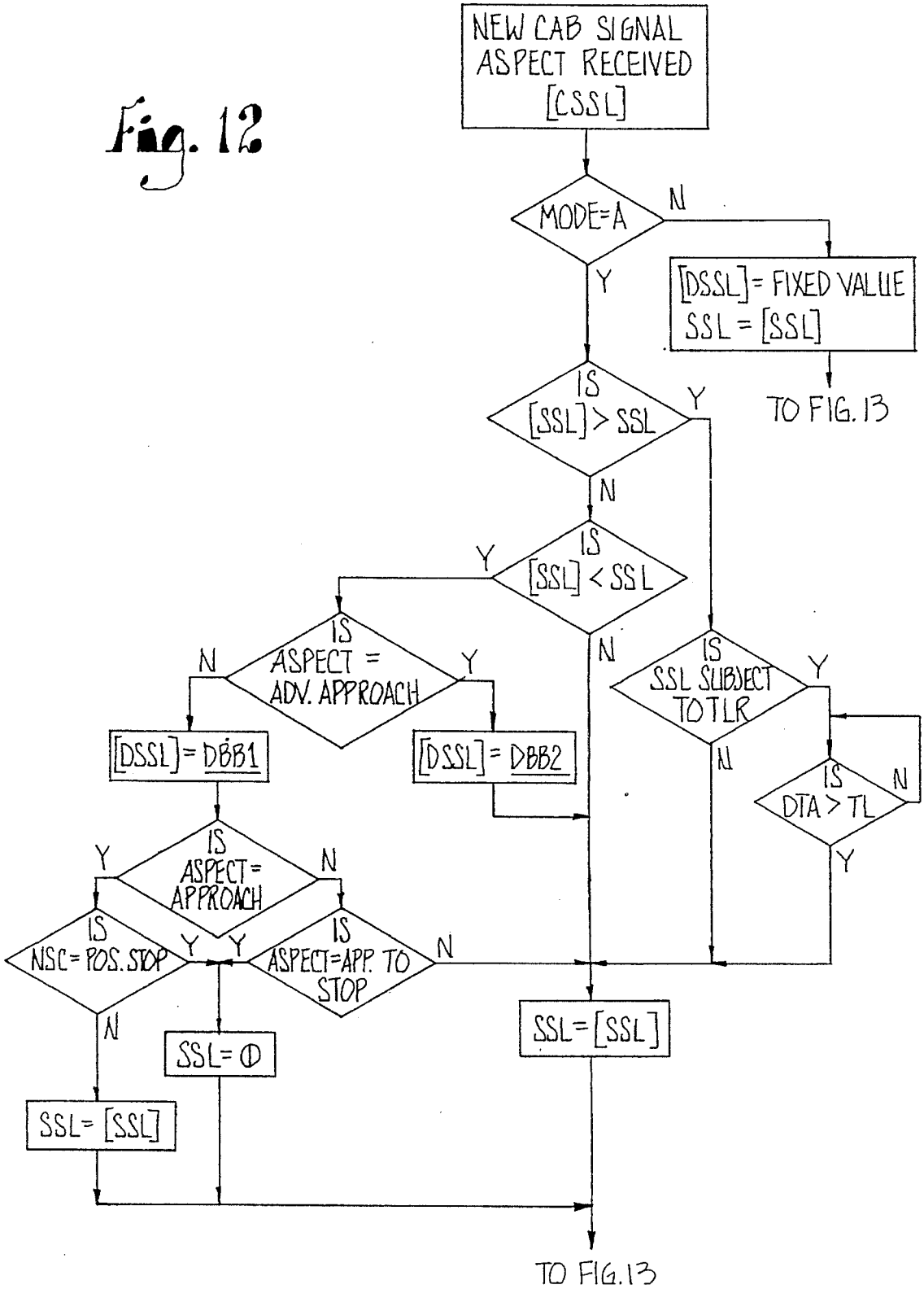

The FIG. 12 routine runs whenever a new cab signal aspect is received while operating in Mode A, which may occur at block boundaries or anywhere between boundaries. The received aspect includes both an aspect instruction and a Separation Speed Limit [SSL]. If the new value [SSL] is greater than the previous value SSL, the system checks to see if the previous aspect was subject to a Train Length Restriction TLR. If it was, the previous value of CSL is maintained until the train has travelled its own length from the location where the change in aspect occurred. This is determined by comparing Distance Travelled from Aspect DTA to the stored value of Train Length TL. When DTA becomes greater than TL, the value of SSL is changed to the last received value [SSL]. If the Train Length Restriction TLR is not in effect, SSL is immediately set at the value of [SSL].

If the new [SSL] is less than the previous SSL, a series of checks is made on the instruction portion of the new aspect. An ADVANCE APPROACH aspect defines a requirement to be prepared to stop at the second block boundary ahead; all others define requirements applying to the first block boundary. Thus, if the aspect is ADVANCE APPROACH, the initial value of distance [DSSL] is set at the value of DBB2, the distance to the second boundary. In that case, speed limit SSL is set at the value defined by the aspect, or [SSL]. If the aspect is any other than ADVANCE APPROACH, the distance is set at DBB1. In this case, the aspect is checked further. If it is an APPROACH aspect, the NSC value taken from the last block boundary transponder is checked to see if the upcoming signal is a positive stop signal. If it is, the value of SSL is 0, meaning that the braking curve will be taken to a full stop. If not, SSL is set at the value of [SSL]. If the aspect is APPROACH TO STOP, the value of SSL is set at 0 regardless of any NSC information. If the aspect is none of these, SSL is set at the value of [SSL].

The net result and output of this routine is the determination of the Separation Speed Limit SSL and determination of the initial distance to that speed limit, [DSSL]. Beginning with [DSSL], DSSL will continue to decrease as the train moves forward while SSL remains constant until another aspect change occurs. If a cab signal aspect changes while operating in Mode B, there is no transponder data from which to calculate a target point, so [DSSL] is assigned a fixed value and SSL is set at the aspect value [SSL].

Figure 13:
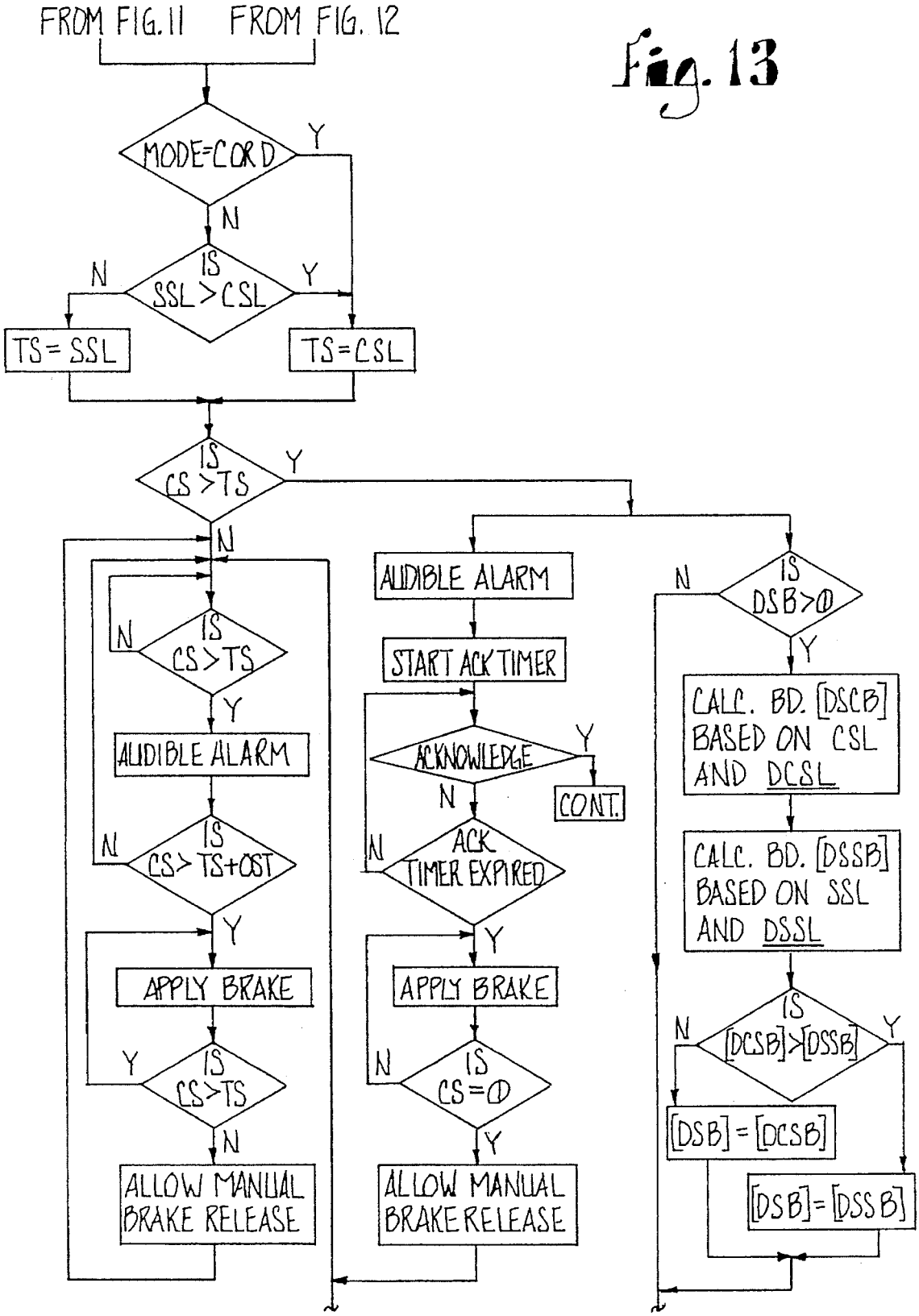
Figure 13:
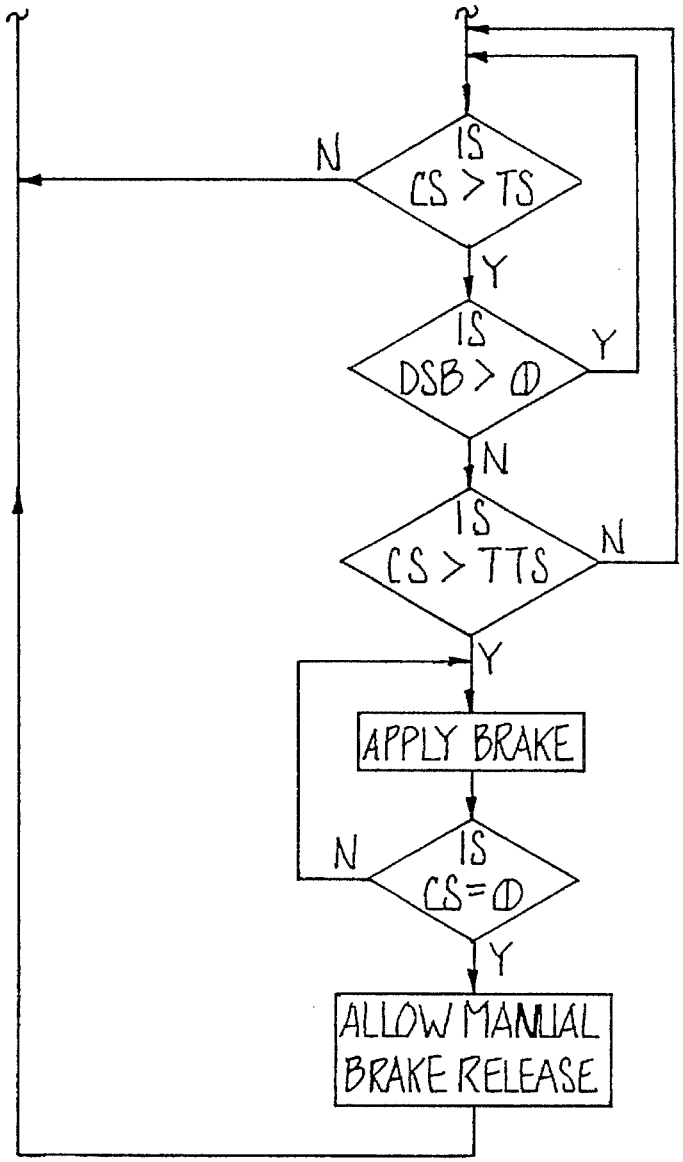

Referring to FIG. 13, most of this routine runs continuously, subject only to interruptions when new data is received by means of one of the earlier described routines. If the system is operating in Mode C or D, there is no dynamic data from which to determine a value for SSL, so TS is set at the value of CSL. If operating in Mode A or B, periodically the values of CSL and SSL are compared. If CSL is lower than SSL, Target Speed TS is established at the value of CSL. Otherwise TS is set at the value of SSL.

If the Current Speed CS is not greater than Target Speed TS, the system goes into a continuing cycle in which CS is compared to TS. Any time that CS exceeds TS, an audible alarm begins sounding and CS is compared to a value of TS plus an Overspeed Tolerance OST. The alarm sounds until CS is no longer greater than TS. If CS reaches a value that exceeds TS plus the tolerance OST, an automatic brake application is made which the operator cannot release until CS no longer exceeds TS. At that point the brake is not removed automatically, but the operator is able to release the brake.

If CS exceeds TS as a result of a target speed change, a speed reduction will be required and two simultaneous responses occur. As one response, an audible alarm is sounded in the operator's cab, which the operator is expected to acknowledge within a certain time limit by pressing a special acknowledgement switch. If the acknowledgement switch is not pressed within the time limit, a penalty brake is applied automatically and the operator cannot release the brake until the current speed has reduced to 0. After stopping, the operator can resume travel, subject to maintaining CS at no more than TS as outlined above. As the other response, the system checks to see if a braking curve is already in effect due to other reasons. If a braking curve is in effect (DSB<0), it is maintained until CS is no longer greater than TS, terminating at the new proper target speed TS which must then be maintained as described above.

If a braking curve is not already in effect (DSB>0), the system calculates two different braking requirements. One is the Braking Distance BD and Distance to Start of Civil speed Braking [DSCB], based on the current values of CSL and DCSL. The other is the distance BD and Distance to Start of Separation speed Braking [DSSB], based on current values of SSL and DSSL. The resulting initial value of Distance to Start of Braking [DSB] assumes the lower of DSSB or DSCB. DSB becomes a decreasing value, decreasing with train movement.

Following this, CS is again compared to TS. If CS remains higher than TS until DSB reaches 0, a braking curve is entered. As in any braking curve, CS is continuously compared to a Transient Target Speed TTS which decreases according to a mathematical function derived from CS at the point where braking begins, Target Speed TS, and the distance since start of braking (absolute value of DSB). When the CS reaches TS, the braking routine is completed and TS is maintained as described above. If CS ever exceeds TTS while in braking, a penalty brake is applied automatically and cannot be released until CS =0. At that time, the operator can release the brake and may continue at speeds not exceeding TS, as described above.

I claim:

1. In a system for controlling the movement of a train along a railroad track, the combination comprising:

a plurality of localized transmitting units spaced along said track at preselected locations and each having means for transmitting fixed data appropriate to the respective location including a timetable speed limit to be observed by a train and said fixed data transmitted from certain of said transmitting units including information defining a point along the track at which a speed change is in effect; and data receiving and processing means adapted to be carried by a train for intermittently receiving said fixed data as the train successively passes said locations, and responding to the data received at each location and the speed and direction of movement of the train for determining train control instructions therefrom.

2. The combination as claimed in claim 1, wherein said speed change is a speed restriction, said data receiving and processing means including means for determining the distance within which the train must decrease its speed in order to comply with the speed restriction in effect at said point.

3. The combination as claimed in claim 1, further comprising means responsive to said instructions for displaying the same to a train crew and enforcing any restrictive instructions that are not obeyed.

4. The combination as claimed in claim 1, wherein said fixed data further includes multiple values for said timetable speed limit, each of said values being associated with a particular class of train under the control of said system.

5. The combination as claimed in claim 1, wherein said fixed data further includes the direction of movement of traffic for which the data applies.

6. The combination as claimed in claim 1, wherein said information includes distance along the track to the point at which the speed change is in effect.

7. In a system for controlling the movement of a train along a railroad track, the combination comprising:

first and second localized transmitting units spaced along said track at preselected locations and each having means for transmitting fixed data appropriate to the respective location, said first transmitting unit being located at a point along said track in advance of a speed restriction and said fixed data transmitted therefrom including distance to the start of the speed restriction, said second transmitting unit being located at a point along said track at which the speed restriction ends, and said fixed data transmitted therefrom including a subsequent timetable speed limit to be observed, and data receiving and processing means adapted to be carried by a train for receiving said fixed data from the respective transmitting units as the train successively passes said locations, and responding to the data received at each location and the speed and direction of movement of the train for determining train control instructions therefrom.

8. The combination as claimed in claim 7, wherein said data receiving and processing means includes means for requiring the head end of a train to travel a distance past said point at which the speed restriction ends before removing the speed restriction from said instructions, said distance being equivalent to the length of the train.

* * * * *